US011021672B2

(12) United States Patent
Imai et al.

(10) Patent No.: US 11,021,672 B2
(45) Date of Patent: Jun. 1, 2021

(54) LUBRICANT COMPOSITION FOR SPEED REDUCER AND SPEED REDUCER

(71) Applicants: KYODO YUSHI CO., LTD., Fujisawa (JP); Nabtesco Corporation, Tokyo (JP)

(72) Inventors: Junichi Imai, Fujisawa (JP); Ryosuke Ichimura, Kawasaki (JP); Ryosuke Saito, Chigasaki (JP); Ko Tanimura, Fujisawa (JP); Hongyou Wang, Tokyo (JP); Takahide Kumagai, Tokyo (JP); Yasuyuki Hattori, Tokyo (JP)

(73) Assignees: KYODO YUSHI CO., LTD., Fujisawa (JP); NABTESCO CORPORATION, Tokyo (JP)

( * ) Notice: Subject to any disclaimer, the term of this patent is extended or adjusted under 35 U.S.C. 154(b) by 0 days.

(21) Appl. No.: 15/372,898

(22) Filed: Dec. 8, 2016

(65) Prior Publication Data

US 2017/0183603 A1 Jun. 29, 2017

(30) Foreign Application Priority Data

Dec. 25, 2015 (JP) ..... JP2015-255180

(51) Int. Cl.

| | |
|---|---|
| ***C10L 1/22*** | (2006.01) |
| ***C07C 309/62*** | (2006.01) |
| ***C10M 169/04*** | (2006.01) |
| ***C10M 117/04*** | (2006.01) |
| ***C10M 137/10*** | (2006.01) |
| *C10N 30/02* | (2006.01) |
| *C10N 30/06* | (2006.01) |
| *C10N 40/04* | (2006.01) |

(52) U.S. Cl.

CPC ..... *C10M 169/044* (2013.01); *C10M 117/04* (2013.01); *C10M 137/10* (2013.01); *C10M 2203/003* (2013.01); *C10M 2203/024* (2013.01); *C10M 2205/022* (2013.01); *C10M 2205/024* (2013.01); *C10M 2207/1265* (2013.01); *C10M 2219/044* (2013.01); *C10M 2219/046* (2013.01); *C10M 2219/066* (2013.01); *C10M 2223/045* (2013.01); *C10N 2030/02* (2013.01); *C10N 2030/06* (2013.01); *C10N 2040/04* (2013.01)

(58) Field of Classification Search

CPC ..... C10M 2205/16; C10M 135/02
USPC ..... 508/390, 241
See application file for complete search history.

(56) References Cited

U.S. PATENT DOCUMENTS

| | | | | |
|---|---|---|---|---|
| 3,884,820 | A * | 5/1975 | Miller | C10M 5/00 508/521 |
| 4,690,010 | A | 9/1987 | Matsumoto et al. | |
| 4,846,018 | A | 7/1989 | Matsumoto et al. | |
| 4,928,556 | A | 5/1990 | Matsumoto et al. | |
| 2003/0207971 | A1* | 11/2003 | Stuart, Jr. | A61K 8/042 524/274 |
| 2007/0149422 | A1 | 6/2007 | Miyajima et al. | |
| 2008/0295623 | A1 | 12/2008 | Kurita et al. | |
| 2009/0088354 | A1* | 4/2009 | Berry | C10M 169/02 508/388 |
| 2010/0197541 | A1* | 8/2010 | Li Pi Shan | C08F 295/00 508/591 |
| 2012/0316091 | A1* | 12/2012 | Kawamura | C10M 115/08 508/100 |
| 2013/0157915 | A1 | 6/2013 | Azuma et al. | |
| 2013/0237463 | A1* | 9/2013 | Yagishita | C10M 141/10 508/365 |
| 2013/0331307 | A1* | 12/2013 | Meijer | C10M 169/06 508/534 |
| 2015/0045272 | A1* | 2/2015 | Fujimaki | C10M 141/06 508/503 |
| 2015/0024710 | A1 | 9/2015 | Yamazaki | |

FOREIGN PATENT DOCUMENTS

| | | | |
|---|---|---|---|
| CN | 1771316 | A | 5/2006 |
| CN | 103080286 | A | 5/2013 |
| CN | 103805322 | A | 5/2014 |
| JP | S62-004586 | A | 1/1987 |
| JP | H09-194867 | A | 7/1997 |
| JP | 2004-231714 | A | 8/2004 |

(Continued)

OTHER PUBLICATIONS

Notice of Reasons for Refusal issued by the Japanese Patent Office in corresponding Japanese Patent Application No. 2015-255180 dated Jul. 25, 2019 (8 pages including partial English translation).

Office Action (Notice of Reasons for Refusal) dated Apr. 9, 2020, by the Japanese Patent Office in corresponding Japanese Patent Application No. 2015-255180 and an English Translation of the Office Action. (14 pages).

Office Action (The First Office Action) dated Sep. 2, 2020, by the State Intellectual Property Office of People's Republic of China in corresponding Chinese Patent Application No. 201611168208.X and an English Translation of the Office Action. (14 pages).

Peng, H., et al., "Development and Application of Lubricating Grease for Industrial Robot Joint Reducer", pp. 25-29.

*Primary Examiner* — Prem C Singh
*Assistant Examiner* — Francis C Campanell
(74) *Attorney, Agent, or Firm* — Buchanan Ingersoll & Rooney PC

(57) ABSTRACT

The invention provides a lubricant composition for an eccentrically oscillating speed reducer of planetary gear type, which is capable of extending the life of the speed reducer under high temperatures and keeping low input torque at low temperatures, and includes (a) a base oil containing a synthetic oil, (b) a hydrocarbon wax, and (c) at least one calcium salt selected from the group consisting of a calcium salt of petroleum sulfonic acid, a calcium salt of alkyl aromatic sulfonic acid, a calcium salt of oxidized wax, an overbasic calcium salt of petroleum sulfonic acid, an overbasic calcium salt of alkyl aromatic sulfonic acid, and an overbasic calcium salt of oxidized wax.

15 Claims, No Drawings

(56) References Cited

FOREIGN PATENT DOCUMENTS

| | | | |
|---|---|---|---|
| JP | 2004-339411 | A | 12/2004 |
| JP | 2004-345595 | A | 12/2004 |
| JP | 2006044306 | A | 2/2006 |
| JP | 2006-077980 | A | 3/2006 |
| JP | 2008-106204 | A | 5/2008 |
| JP | 2008-115304 | A | 5/2008 |
| JP | 2008-265701 | A | 11/2008 |
| JP | 2008-274141 | A | 11/2008 |

* cited by examiner

LUBRICANT COMPOSITION FOR SPEED REDUCER AND SPEED REDUCER

TECHNICAL FIELD

The present invention relates to a lubricant composition that can be used for an eccentrically oscillating speed reducer of planetary gear type, and the eccentrically oscillating speed reducer of planetary gear type where the lubricant composition is enclosed.

BACKGROUND ART

The inside of the speed reducer has a plurality of sliding portions and rolling portions. Upon applying a torque to the input side, the speed reducer can reduce the speed and transmit the higher torque to the output side. This kind of speed reducer is widely used, for example in the fields of transportation of railway, aircraft, ship and the like as well as the robot-related industrial fields.

The speed reducer is required to output the constant torque over an extended period of time. Especially when the speed reducer (e.g., an eccentrically oscillating speed reducer as disclosed in JP 2006-077980 A) is placed in the joints of robots, the output torque should be constant and required to be changed as little as possible for achieving the precise motions. In fact, however, there has been the problem that the output torque will gradually become larger because the parts in the speed reducer are apt to change in shape as a result of the operation of the speed reducer. For example, a steel portion which is brought into sliding contact with another steel portion is susceptible to damage, which causes the problem that the output torque will largely vary. This problem is noticeable under the high temperatures. Namely, the life of the speed reducer tends to shorten when the temperature increases.

Conventionally, a lubricating oil or grease which comprises molybdenum dithiocarbamate and a calcium salt for increasing the effects of reducing the inner friction and improving the speed reduction efficiency is proposed as the lubricant composition for the speed reducer (for example, as in JP 2004-339411 A). However, the lubricant composition comprising the molybdenum dithiocarbamate and calcium salt is not satisfactory in terms of the life of the speed reducer under high temperatures.

Currently, the operating environments of the speed reducers have been diversified. In consideration of the above, proper operation of the speed reducer in a cold district or the like is also demanded. In the cold district, the input torque (starting torque) tends to increase under low temperatures in winter, thereby lowering the starting efficiency of the speed reducer. Accordingly, it is desired to develop a lubricant composition for the speed reducer capable of showing high durability under high temperatures and also reducing the input torque under low temperatures.

SUMMARY OF INVENTION

Technical Problem

An object of the invention is to provide a lubricant composition that can be used for an eccentrically oscillating speed reducer of planetary gear type, capable of showing high durability and long life under high temperatures, and reducing the input torque under low temperatures.

Another object is to provide an eccentrically oscillating speed reducer of planetary gear type, capable of showing high durability and long life under high temperatures, and reducing the input torque under low temperatures.

Solution to Problem

For the purpose of achieving the above-mentioned objects, the present invention provides the followings.

1. A lubricant composition for an eccentrically oscillating speed reducer of planetary gear type, comprising the following components (a) to (c):

(a) a base oil comprising a synthetic oil, (b) a hydrocarbon wax, and (c) at least one calcium salt selected from the group consisting of a calcium salt of petroleum sulfonic acid, a calcium salt of alkyl aromatic sulfonic acid, a calcium salt of oxidized wax, an overbasic calcium salt of petroleum sulfonic acid, an overbasic calcium salt of alkyl aromatic sulfonic acid, and an overbasic calcium salt of oxidized wax.

2. The lubricant composition for the reducer described in the above-mentioned item 1, wherein the hydrocarbon wax (b) is at least one selected from the group consisting of polyethylene wax and polypropylene wax.

3. The lubricant composition for the reducer described in the above-mentioned item 1 or 2, wherein the hydrocarbon wax (b) is contained in an amount of 0.1 to 20 mass % of the total mass of the composition.

4. The lubricant composition for the reducer described in any one of the above-mentioned items 1 to 3, wherein the synthetic oil in the base oil (a) is a synthetic hydrocarbon oil.

5. The lubricant composition for the reducer described in any one of the above-mentioned items 1 to 4, wherein the base oil (a) has a kinematic viscosity at 40° C. of 20 to 300 mm/s.

6. The lubricant composition for the reducer described in any one of the above-mentioned items 1 to 5, wherein the calcium salt (c) is a combination of calcium salts of alkyl aromatic sulfonic acid and overbasic calcium salts of alkyl aromatic sulfonic acid.

7. An eccentrically oscillating speed reducer of planetary gear type, where the lubricant composition described in any one of the above-mentioned items 1 to 6 is enclosed.

Effects of Invention

The lubricant composition for the speed reducer according to the invention can make the life of the reducer longer under high temperatures than the conventional ones. The speed reducer of the invention where the above-mentioned lubricant composition is enclosed can exhibit the longer life under high temperatures. In addition, the lubricant composition for the speed reducer according to the invention can prevent the input torque from becoming larger under low operating temperatures. Therefore, the speed reducer of the invention where the above-mentioned lubricant composition is enclosed can be appropriately operated in the cold district or the like. Further, the lubricant composition for the speed reducer according to the invention can increase the starting efficiency of the reducer.

DESCRIPTION OF EMBODIMENTS

<Base Oil>

The base oil (a) used in the invention comprises a synthetic oil. Other base oil components such as a mineral oil or the like may also be contained in the base oil. Any synthetic oils generally used in the conventional lubricant compositions, for example, synthetic hydrocarbon oil, ester oil, phenyl ether, polyglycol and the like are usable in the invention. One kind of synthetic oil may be used alone, or two or more kinds of synthetic oils may be used in combination. In particular, the synthetic hydrocarbon oil is preferably used. More specifically, one or more α-olefins are mixed and polymerized for preparation of the synthetic hydrocarbon oil. Examples of the α-olefin include ethylene, propylene, butene, and the derivatives thereof. Preferably, α-olefins having 6 to 18 carbon atoms (e.g., 1-decene, 1-dodecene and the like) can be used. The most preferable synthetic hydrocarbon oil is an oligomer of 1-decene or 1-dodecene, which is called poly α-olefin (PAO).

Preferably, the base oil may comprise a synthetic hydrocarbon oil such as PAO, and more preferably, the synthetic hydrocarbon oil such as PAO may be used in combination with the mineral oil.

The content of the synthetic oil (for example, the synthetic hydrocarbon oil such as PAO) in the base oil may preferably be in the range of 10 to 100 mass %, and more preferably 10 to 50 mass %, for example 10 to 20 mass %. When the ratio of the synthetic oil is lower than 10 mass %, there is a risk of the input torque becoming higher under low temperatures.

The base oil is preferably contained in the lubricant composition in an amount of 50 to 99 mass %, more preferably 70 to 95 mass %.

The base oil used in the invention may have a kinematic viscosity at 40° C. of 20 to 300 $mm^2/s$, preferably 30 to 220 $mm^2/s$ (for example, 40 to 200 $mm^2/s$), and more preferably 50 to 150 $mm^2/s$ (for example, 60 to 100 $mm^2/s$). When the kinematic viscosity of the base oil is lower than 20 $mm^2/s$, the sufficient life may not be obtained under high temperatures. With the kinematic viscosity of more than 300 $mm^2/s$, some problems are apt to occur when the operation is started. The kinematic viscosity of the base oil at 40° C. is determined in accordance with the JIS K 2283.

<Hydrocarbon Wax>

The hydrocarbon wax (b) used in the invention is not particularly limited, but may comprise at least one compound selected from the group consisting of a polyolefin wax (such as polyethylene wax, oxidized polyethylene wax, polypropylene wax, ethylene-propylene copolymer wax and the like), montan wax, and amide wax.

In particular, the polyolefin wax is preferred. The weight-average molecular weight of the polyolefin wax, which is not particularly limited may be in the range of about 1,000 to 20,000. The melting viscosity of the polyolefin wax, which is not particularly limited may be in the range of 25,000 to 30,000 mPa s at 140° C., or in the range of 9,000 to 10,000 mPa s at 170° C. The density of the polyolefin wax is not particularly limited either. Any of the high-density polyolefin wax (with a density of 0.96 $g/cm^3$ or more, for example), the medium-density polyolefin wax (with a density ranging from 0.94 to 0.95 $g/cm^3$, for example) and the low-density polyolefin wax (with a density of 0.93 $g/cm^3$ or less, for example) can be used. The high-density polyolefin wax is characterized by the high melting point, softening point and crystallinity, and high degree of hardness; while the low-density polyolefin wax has the low melting point and softening point and exhibits the softness. In consideration of the heat-resistance, the dropping point of the polyolefin wax may preferably be 100° C. or more, and more preferably 110° C. or more. From the viewpoint of the solubility in the base oil, the dropping point of the polyolefin wax may preferably be 150° C. or less, and more preferably 135° C. or less. The acid value of the polyolefin wax may preferably be in the range of 0 to 10 mgKOH/g, and more preferably 0 to 5 mgKOH/g. When the acid value is within the above-mentioned range, oxidative deterioration of the resultant lubricant composition by acid components can be reduced.

At least one kind of polyolefin wax selected from the group consisting of polyethylene wax, polypropylene wax, and ethylene-propylene copolymer wax is preferable, and at least one kind of polyolefin wax selected from the group consisting of polyethylene wax and polypropylene wax is more preferable.

Specific examples of the commercially available polyethylene wax include Licowax PE520, Licowax PE190 and Licowax PE130 (made by Clariant Japan K.K.); and specific examples of the commercially available polypropylene wax include Licosen PP 7502, Licosen PP 3602 and Ceridust 6050M (made by Clariant Japan K.K.) and Hi-WAX NP105 and Hi-WAX NP500 (made by Mitsui Chemicals, Inc.).

The most preferable hydrocarbon wax is polypropylene wax.

The content of the hydrocarbon wax may be in the range of 0.1 to 20 mass %, preferably 0.1 to 10 mass %, more preferably 0.5 to 7 mass %, and most preferably 1 to 5 mass %, based on the total mass of the lubricant composition.

<Calcium Salt>

The calcium salt (c) used in the invention is at least one selected from the group consisting of a calcium salt of petroleum sulfonic acid, a calcium salt of alkyl aromatic sulfonic acid, a calcium salt of oxidized wax, an overbasic calcium salt of petroleum sulfonic acid, an overbasic calcium salt of alkyl aromatic sulfonic acid, and an overbasic calcium salt of oxidized wax.

The term "overbasic calcium salt of X" herein used means a calcium salt of X having a base number of 200 mgKOH/g or more when determined in accordance with JIS K 2501. When simply expressed as "calcium salt of X," the corresponding calcium salt of X does not indicate an overbasic salt, but a neutral or basic calcium salt, that is, a calcium salt of X having a basic number of less than 200 mgKOH/g when determined in accordance with JIS K 2501.

Particularly, use of at least one calcium salt selected from the group consisting of the calcium salt of alkyl aromatic sulfonic acid and the overbasic calcium salt of alkyl aromatic sulfonic acid is preferred. It is more preferable to use the calcium salt of alkyl aromatic sulfonic acid in combination with the overbasic calcium salt of alkyl aromatic sulfonic acid. In the above-mentioned combination, the ratio of the overbasic calcium salt of alkyl aromatic sulfonic acid may be in the range of 50 to 99 mass %, preferably 60 to 90 mass %, and more preferably 65 to 80 mass %. This can further improve the durability under high temperatures.

The calcium salt may preferably be contained in an amount of 0.1 to 20 mass %, more preferably 0.5 to 10 mass %, for example within a range of 1 to 5 mass %, based on the total mass of the lubricant composition of the invention. When the content of the calcium salt is less than 0.1 mass %, the life under high temperatures may be unsatisfactory. However, even when the calcium salt is contained in an amount of more than 20 mass %, the resultant effect will be saturated.

<Thickener>

The lubricant composition of the invention may further comprise a thickener (d). Any thickeners can be used, and to be specific, soap type thickeners such as Li soaps and Li complex soaps, urea type thickeners such as diurea compounds, inorganic thickeners such as organoclay and silica, organic thickeners such as PTFE, and the like are usable. In particular, the Li soap type thickeners and the urea type thickeners are preferable, and the former thickeners are more preferred.

The content of the thickener may preferably be in the range of 0 to 20 mass % (for example, 1 to 15 mass %), and more preferably 0.5 to 10 mass % (for example, 0.5 to 3 mass %), based on the total mass of the lubricant composition of the invention. When the content of the thickener is less than 0.5 mass %, sufficient thickening effect cannot be expected. On the other hand, when the content of the thickener exceeds 20 mass %, the resultant lubricant composition will become too hard to penetrate into a portion to be lubricated, which makes it difficult to obtain the satisfactory results.

When the lubricant composition of the invention comprises a thickener, the worked penetration of the resultant composition of the invention may preferably be in the range of 300 to 450 (for example, 350 to 410), and more preferably 395 to 425. The worked penetration herein used means a cone penetration measured immediately after the plunger of a given test apparatus is stroked 60 times while the sample is maintained in the apparatus, as defined in JIS K 2220.

The lubricant composition of the invention may further comprise other optional additives when necessary. The optional additives include a rust inhibitor or detergent-dispersant not including any calcium salt (c), an extreme pressure agent, an antioxidant, a metal corrosion inhibitor, an oiliness improver, an antiwear agent, a solid lubricant and the like. In particular, the extreme pressure agent (e) is preferably used.

<Extreme Pressure Agent>

The extreme pressure agent (e) that can be optionally used in the invention is not particularly limited. For example, at least one selected from the group consisting of thiophosphates and thiocarbamates can be used as the extreme pressure agent. The thiophosphates include dithiophosphates, such as zinc salt or molybdenum salt of dithiophosphoric acid (e.g., dialkyldithiophosphoric acid). The thiocarbamates include dithiocarbamates, such as zinc salt or molybdenum salt of dithiocarbamic acid (e.g., dialkyldithiocarbamic acid).

The preferable extreme pressure agent is at least one selected from the group consisting of molybdenum dithiocarbamate and zinc dithiophosphate. Use of molybdenum dithiocarbamate (in particular, molybdenum dialkyldithiocarbamate) in combination with zinc dithiophosphate (in particular, zinc dialkyldithiophosphate is more preferable. In the above-mentioned combination, the ratio of the molybdenum dithiocarbamate may preferably be 50 to 99 mass %, and more preferably 55 to 90 mass.

The extreme pressure agent may be contained in an amount of 0 to 1.5 mass %, and more preferably 0.5 to 1 mass %, based on the total mass of the lubricant composition of the invention. When the content of the extreme pressure agent exceeds 1.5 mass %, precipitation of the additive may cause vibration or other problems of the speed reducer more frequently.

According to one preferable aspect, the invention provides a lubricant composition that can be used for an eccentrically oscillating speed reducer of planetary gear type, comprising the following components (a) to (e):

(a) a base oil comprising a synthetic hydrocarbon oil, (b) at least one selected from the group consisting of polyethylene wax and polypropylene wax, (c) at least one calcium salt selected from the group consisting of a calcium salt of alkyl aromatic sulfonic acid and an overbasic calcium salt of alkyl aromatic sulfonic acid, (d) a Li-soap thickener, and (e) at least one selected from the group consisting of molybdenum dithiocarbamate and zinc dithiophosphate.

The lubricant composition of the invention can be used for an eccentrically oscillating speed reducer of planetary gear type. Especially, in light of the advantages of excellent durability under high temperatures and minimum variation of the output torque, the lubricant composition is preferably used for the eccentrically oscillating speed reducer of planetary gear type set in the joints of robots. One of the typical eccentrically oscillating speed reducers of planetary gear type has a first-stage speed reduction mechanism and a second-stage speed reduction mechanism. The first-stage speed reduction mechanism is designed to reduce the rotational speed of a motor and transmit the reduced speed to the second-stage speed reduction mechanism. The second-stage speed reduction mechanism comprises an inner gear, an outer gear meshing with the inner gear, a crankshaft engaged with the outer gear to allow the outer gear to set up an eccentrically oscillating motion with respect to the inner gear, and a support which supports the crankshaft rotatably, with the output being taken out from the inner gear or the support.

EXAMPLES

The invention will now be explained more specifically by referring to the following examples, which are not intended to be limiting thereof.

Examples 1 to 4 and Comparative Examples 5 to 7

Lubricant compositions of Examples 1 to 4 and Comparative Examples 5 to 7 were prepared by mixing the components at the ratios as shown in Table 1. The kinematic viscosity and the worked penetration of each base oil used in those lubricant compositions were determined in accordance with the methods shown below.

(Kinematic Viscosity of Base Oil)

The kinematic viscosity of each base oil was measured at 40° C. in accordance with JIS K 2220 23.

(Worked Penetration)

The worked penetration was measured immediately after the plunger of a given test apparatus was stroked 60 times while the base oil sample was maintained in the apparatus, as defined in JIS K 2220 7.

Each lubricant composition was fed into the eccentrically oscillating speed reducer of planetary gear type (RV-42N3-127.15, made by Nabtesco Corporation) to carry out the tests for determining the life, the torque under a low temperature, and the starting efficiency.

(Test for Determining the Life)

Using each of the lubricant compositions, the test was conducted under the following conditions to determine the time duration until there occurred some damage in the inner parts.

<Test Conditions>

Test temperature: 60° C.

With the torque to be loaded and the number of revolutions at the output side being arbitrarily set, the bearing life was calculated according to the formula estimating the bearing life.

The high-temperature durability was expressed as the relative ratio of the life to the life obtained in Comparative Example 6 which was supposed to be "1." The high-temperature durability was evaluated based on the criteria of judgment shown below.

<Criteria of Judgment>

The relative life ratio of 3.0 or more: oo (acceptable).

The relative life ratio of 2.5 or more and less than 3.0: o (acceptable).

The relative life ratio of less than 2.5: x (unacceptable).

(Test for Determining the Torque at Low Temperature)

Using each of the lubricant compositions, the test was conducted under the following conditions. The input torque at a low temperature was determined by reading the torque of the input shaft necessary for rotating the speed reducer with no load being applied.

<Test Conditions>

Test temperature: −10° C.

Load applied to the radial direction, i.e., the direction perpendicular to the shaft: absent The number of revolutions on the output side: 15.7 rpm The starting efficiency was expressed as the relative ratio of the starting efficiency in each Example to the starting efficiency obtained in Comparative Example 6 which was supposed to be "1." The starting efficiency was evaluated based on the criteria of judgment shown below.

<Criteria of Judgment>

The relative efficiency of 1.4 or more: oo (acceptable).

The relative efficiency of 1.2 or more and less than 1.4: o (acceptable).

The relative efficiency of less than 1.2: x (unacceptable).

(Overall Evaluation)

The lubricant composition passed all the tests (high-temperature durability, low-temperature performance and starting efficiency): o (acceptable).

The lubricant composition failed any one of the above tests: x (unacceptable)

The formulations of the lubricant compositions and the test results are shown in Table 1.

TABLE 1

| | | | Examples | | | | Comparative Examples | | |
|---|---|---|---|---|---|---|---|---|---|
| | | | 1 | 2 | 3 | 4 | 5 | 6 | 7 |
| (a) Base oil (Ratio by mass in base oil) | Mineral oil | | 80 | 80 | 80 | 80 | 100 | 80 | 80 |
| | Synthetic hydrocarbon oil (PAO) | | 20 | 20 | 20 | 20 | — | 20 | 20 |
| | Kinematic viscosity at 40° C. ($mm^2/s$) | | 72 | 72 | 72 | 72 | 72 | 72 | 72 |
| Additives (Mass % based on the total mass of composition) | (b) Hydrocarbon waxes | Polyethylene wax | — | 5 | — | — | — | — | — |
| | | Polypropylene wax | 5 | — | 5 | 5 | 5 | — | 5 |
| | (c) Ca salts | Ca sulfonate A | 1.2 | 1.2 | 1.2 | 1.2 | 1.2 | 1.2 | — |
| | | Ca sulfonate B | — | — | 0.6 | 0.6 | — | — | — |
| | (d) Thickener | Li-soap thickener | 3.0 | 3.0 | 3.0 | 3.0 | 3.0 | 3.0 | 3.0 |
| | (e) Extreme pressure agents | MoDTC | 1.3 | 1.3 | 1.3 | 1.3 | 1.3 | 1.3 | 1.3 |
| | | ZnDTP | — | — | — | 1.0 | — | — | — |
| Worked penetration | | | 410 | 410 | 410 | 410 | 410 | 410 | 410 |
| High-temperature durability | | Results | 2.4 | 2.3 | 2.5 | 3.1 | 2.1 | 1.0 | 1.8 |
| | | Judgment | o | o | oo | oo | o | x | x |
| Low-temperature performance | | Results | 0.4 | 0.4 | 0.4 | 0.4 | 1.0 | 0.4 | 0.4 |
| | | Judgement | o | o | o | o | x | o | o |
| Starting efficiency | | Results | 1.3 | 1.3 | 1.4 | 1.5 | 1.3 | 1.0 | 1.1 |
| | | Judgment | o | o | oo | oo | o | x | x |
| Overall evaluation | | | o | o | o | o | x | x | x |

The low-temperature performance was expressed as the relative ratio of the torque read in each Example to the torque of Comparative Example 5 which was supposed to be "1." The low-temperature performance was evaluated based on the criteria of judgment shown below.

<Criteria of Judgment>

The relative torque ratio of 0.4 or less (at −10° C.): o (acceptable).

The relative torque ratio of more than 0.4 (at −10° C.): x (unacceptable).

(Test for Determining the Starting Efficiency)

Using each of the lubricant compositions, the test was conducted under the following conditions. The starting efficiency was determined by calculating the ratio of the actual value of the output torque to the theoretical value of the output torque obtained when the torque of the input shaft was output at 100%.

<Test Conditions>

Test temperature: 25° C.

Torque (load applied to the radial direction, i.e., the direction perpendicular to the shaft): 42 kgf-m The hydrocarbon waxes (b), the calcium salts (c), the thickener (d) and the extreme pressure agents (e) shown in Table 1 are as follows.

(Hydrocarbon Waxes)

Polyethylene wax with a melting viscosity of about 25,000 mPa·s at 140° C., a density of 0.96 $g/cm^3$ and a dropping point of 135° C.

Polypropylene wax with a melting viscosity of about 9,000 mPa·s at 170° C., a density of 0.90 $g/cm^3$ and a dropping point of 112° C.

(Calcium Salts)

Ca sulfonate A (overbasic): a calcium salt of alkyl aromatic sulfonic acid (LUBRIZOL 5283C (tradename) having a base number of 375 mgKOH/g, made by The Lubrizol Corporation.)

Ca sulfonate B (neutral): a calcium salt of alkyl aromatic sulfonic acid (NA-SUL729 (tradename) having a base number of 1 mgKOH/g or less, made by King Industries, Inc.)

(Thickener)

Li-soap thickener: Lithium hydroxystearate obtained by reacting 12-hydroxystearic acid with an aqueous solution of lithium hydroxide in the base oil, and then heating the mixture to 225° C., followed by cooling to 100° C. or less.

(Extreme Pressure Agents)

MoDTC: Molybdenum dialkyldithiocarbamate (ADEKA SAKURA-LUBE (tradename), made by ADEKA Corporation)

ZnDTP: Zinc dialkyldithiophosphate (INFINEUM C9421 (tradename), made by Infineum Japan Ltd.)

As shown in Table 1, the low-temperature performance of the lubricant compositions according to the invention prepared in Examples 1 to 4 is found to be better than that of Comparative Example 5 where no synthetic hydrocarbon oil is contained in the base oil. The high-temperature durability and the starting efficiency of the lubricant compositions according to the invention prepared in Examples 1 to 4 are found to be better than those of Comparative Example 6 where no hydrocarbon wax is added as the additive and those of Comparative Example 7 where no Ca sulfonate is contained.

In particular, the lubricant composition of Example 3 comprising both the Ca sulfonates A and B, and the lubricant composition of Example 4 comprising both the Ca sulfonates A and B and further comprising ZnDTP exhibit much improved high-temperature durability and starting efficiency.

The invention claimed is:

1. A lubricant composition for an eccentrically oscillating speed reducer of planetary gear type, consisting of:

(a) a base oil which is a poly-alpha-olefin or a mixture of a poly-alpha-olefin and a mineral oil, (b) a hydrocarbon wax which is a polypropylene wax or a ethylene-propylene copolymer wax, each of said waxes having a weight-average molecular weight of 1,000 to 20,000, (c) at least one calcium salt selected from the group consisting of a calcium salt of petroleum sulfonic acid, a calcium salt of alkyl aromatic sulfonic acid, a calcium salt of oxidized wax, an overbasic calcium salt of petroleum sulfonic acid, an overbasic calcium salt of alkyl aromatic sulfonic acid, and an overbasic calcium salt of oxidized wax, and (d) an optional additive.

2. The lubricant composition for the speed reducer of claim 1, wherein the hydrocarbon wax (b) is polypropylene wax.

3. The lubricant composition for the speed reducer of claim 1, wherein the hydrocarbon wax (b) is contained in an amount of 0.1 to 20 mass % of the total mass of the composition.

4. The lubricant composition for the speed reducer of claim 1, wherein the base oil (a) has a kinematic viscosity at 40° C. of 20 to 300 $mm^2/s$.

5. The lubricant composition for the speed reducer of claim 1, wherein the calcium salt (c) is a combination of calcium salts of alkyl aromatic sulfonic acid and overbasic calcium salts of alkyl aromatic sulfonic acid.

6. An eccentrically oscillating speed reducer of planetary gear type, where the lubricant composition of claim 1 is enclosed.

7. A lubricant composition for an eccentrically oscillating speed reducer of planetary gear type, comprising:

(a) a base oil which is a poly-alpha-olefin or a mixture of a poly-alpha-olefin and a mineral oil, (b) a hydrocarbon wax which is a polypropylene wax or a ethylene-propylene copolymer wax, (c) at least one calcium salt selected from the group consisting of a calcium salt of petroleum sulfonic acid, a calcium salt of alkyl aromatic sulfonic acid, a calcium salt of oxidized wax, an overbasic calcium salt of petroleum sulfonic acid, an overbasic calcium salt of alkyl aromatic sulfonic acid, and an overbasic calcium salt of oxidized wax, and (d) a thickener, wherein the thickener is selected from the group consisting of Li soap thickeners and urea thickeners, and the lubricant composition has a worked penetration of 350 to 450.

8. The lubricant composition for the speed reducer of claim 7, wherein the hydrocarbon wax (b) has a weight-average molecular weight of 1,000 to 20,000.

9. The lubricant composition for the speed reducer of claim 7, wherein the hydrocarbon wax (b) has a melting viscosity of 25,000 to 30,000 mPa·s at 140° C. or a melting viscosity of 9,000 to 10,000 mPa·s at 170° C.

10. The lubricant composition for the speed reducer of claim 7, wherein the hydrocarbon wax (b) has a dropping point of 100 to 150° C.

11. The lubricant composition for the speed reducer of claim 7, wherein the hydrocarbon wax (b) has an acid value of 0 to 10 mgKOH/g.

12. The lubricant composition for the speed reducer of claim 1, wherein the hydrocarbon wax (b) has a melting viscosity of 25,000 to 30,000 mPa·s at 140° C. or a melting viscosity of 9,000 to 10,000 mPa·s at 170° C.

13. The lubricant composition for the speed reducer of claim 1, wherein the hydrocarbon wax (b) has a dropping point of 100 to 150° C.

14. The lubricant composition for the speed reducer of claim 1, wherein the hydrocarbon wax (b) has an acid value of 0 to 10 mgKOH/g.

15. The lubricant composition for the speed reducer of claim 7, which has a worked penetration of 395 to 425.

* * * * *